US005282671A

United States Patent [19]

Funk

[11] Patent Number: 5,282,671

[45] Date of Patent: Feb. 1, 1994

[54] SWING ARM CHAIR APPARATUS

[76] Inventor: Sonya E. Funk, 629 Mundy St., Watertown, N.Y. 13601

[21] Appl. No.: 939,656

[22] Filed: Sep. 3, 1992

[51] Int. Cl.[5] ..... A47C 7/54

[52] U.S. Cl. ..... 297/411.31; 297/145; 297/194

[58] Field of Search ..... 797/417, 116, 117, 194, 797/145

[56] References Cited

U.S. PATENT DOCUMENTS 847,332 3/1907 Hart ..... 297/417

1,478,640 12/1923 Coverly ..... 297/417 X

FOREIGN PATENT DOCUMENTS 704799 5/1931 France ..... 297/194

*Primary Examiner*—Peter R. Brown

*Attorney, Agent, or Firm*—Leon Gilden

[57] ABSTRACT

A chair member includes first and second arms, with the first arm pivotally mounted to the chair to permit ease of access to individuals of diminished physical capacity permitting ease of access and exit relative to the chair. The swing arm includes a latch mechanism to permit ease of latching of the swing arm relative to the chair structure.

2 Claims, 4 Drawing Sheets

SWING ARM CHAIR APPARATUS

BACKGROUND OF THE INVENTION

1. Field of the Invention

The field of invention relates to adjustable chair structure, and more particularly pertains to a new and improved swing arm chair apparatus wherein the same is arranged to permit pivotal displacement of an arm member relative to the chair structure for ease of access in entry and exit relative to the chair structure.

2. Description of the Prior Art

Chairs of various types have been utilized throughout the prior art to accommodate adjusting for height, back support, and the like. U.S. Pat. No. 3,829,159 to Leffler sets forth a chair structure having pivotally mounted side arms to permit ease of access to the chair in use as a treatment chair structure.

U.S. Pat. No. 3,563,604 sets forth chair structure having arm rest members pivotally mounted to permit displacement of the arm rest relative to the chair structure.

As such, it may be appreciated there continues to be a need for a new and improved swing arm chair apparatus as set forth by the instant invention which addresses both the problems of ease of use as well as effectiveness in construction permitting ease of entry and exit relative to the chair structure and in this respect, the present invention substantially fulfills this need.

SUMMARY OF THE INVENTION

In view of the foregoing disadvantages inherent in the known types of chair apparatus now present in the prior art, the present invention provides a swing arm chair apparatus wherein the same utilizes a swing arm mounted to the chair structure to permit displacement of the swing arm for ease of entry and withdrawal relative to the chair structure. As such, the general purpose of the present invention, which will be described subsequently in greater detail, is to provide a new and improved swing arm chair appartus which has all the advantages of the prior art chair apparatus and none of the disadvantages.

To attain this, the present invention provides a chair member including first and second arms, with the first arm pivotally mounted to the chair to permit ease of access to individuals of diminshed physical capacity permitting ease of access and exit relative to the chair. The swing arm includes a latch mechanism to permit ease of latching of the swing arm relative to the chair structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved swing arm chair apparatus which has all the advantages of the prior art chair apparatus and none of the disadvantages.

It is another object of the present invention to provide a new and improved swing arm chair apparatus which may be easily and efficiently manufactured and marketed.

It is a further object of the present invention to provide a new and improved swing arm chair apparatus which is of a durable and reliable construction.

An even further object of the present invention is to provide a new and improved swing arm chair apparatus which is susceptible of a low cost of manufacture with regard to both materials and labor, and which accordingly is then susceptible of low prices of sale to the consuming public, thereby making such swing arm chair apparatus economically available to the buying public.

Still yet another object of the present invention is to provide a new and improved swing arm chair apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
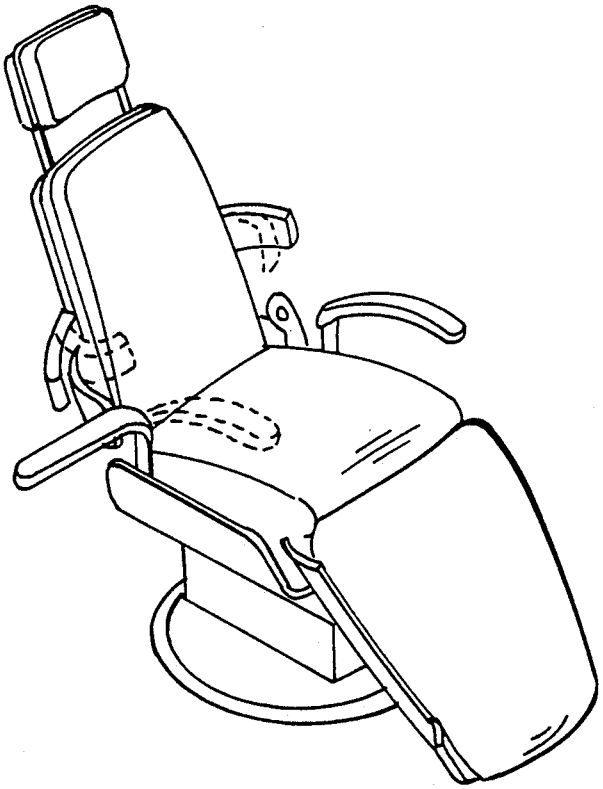
FIG 1 PRIOR ART
FIG. 1 is an isometric illustration of a prior art swing arm type chair construction, as indicated in U.S. Pat. No. 3,829,159.
Figure 2:
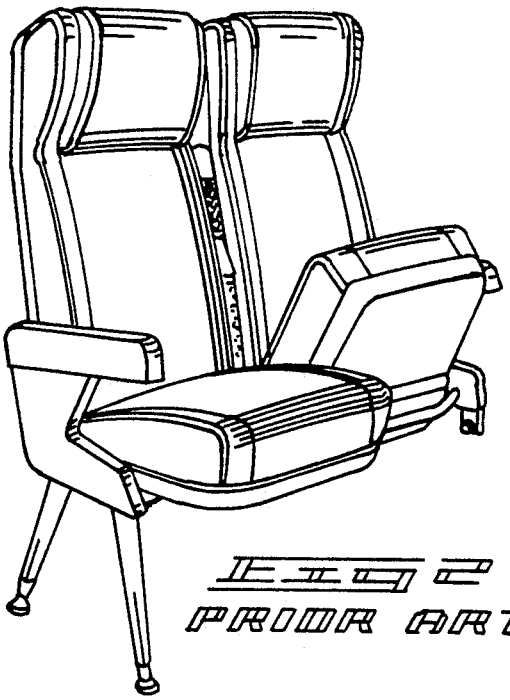
FIG 2 PRIOR ART
FIGS. 2 and 3 are isometric illustrations of a chair structure having a pivotally mounted medial arm rest, as indicated in U.S. Pat. No. 3,563,604.
Figure 3:
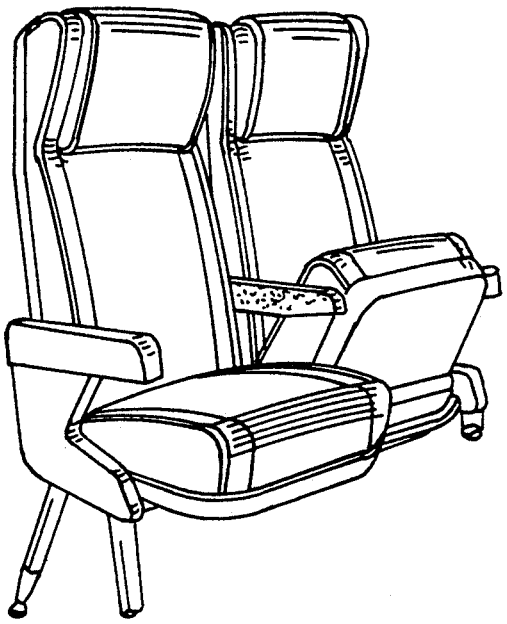
FIG 3 PRIOR ART
Figure 4:
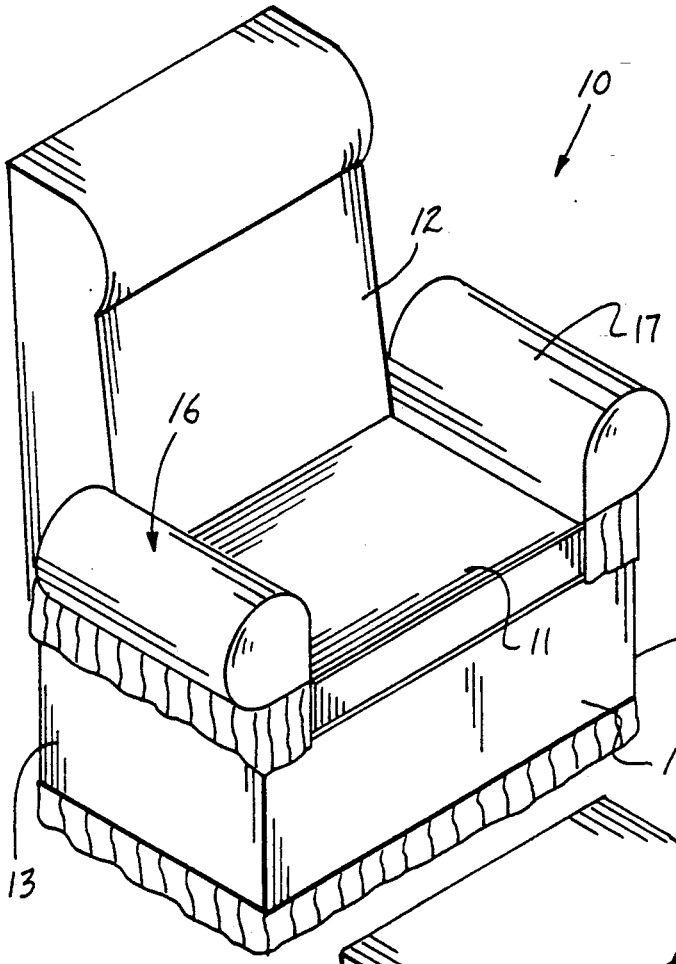
FIG. 4 is an isometric illustration of the invention with the swing arm in a first position.

With reference now to the drawings, and in particular to FIGS. 1 to 7 thereof, a new and improved swing arm chair apparatus embodying the principles and concepts of the present invention and generally designated by the reference numeral 10 will be described.

More specifically, the swing arm chair apparatus 10 of the instant invention essentially comprises a chair structure having a chair seat 11, with a chair back support 12 extending upwardly relative to the chair seat, and the chair including a base portion having a first side wall 13 spaced from a second side wall 14, and a front wall 15. A first arm extends from the back support 12 to the front wall 15 along the first side wall 13. Similarly, a second arm 17 extends along the second side wall 14 from the back support 12 to the front wall 15.

The first side wall (see FIGS. 5 and 6 for example) includes a first side wall top wall 18 oriented at an oblique angle relative to the first side wall, and extends from the first side wall to the chair seat coextensive with the first side wall. A top wall lock bore 19 is orthogonally directed into the top wall 19 in adjacency to the front wall 15 and the chair seat 11.

The arm is formed with a first arm bottom wall 20, with a first arm bottom wall axle 21 orthogonally oriented to the first bottom wall 20 and directed into the first side wall top wall 18. The first arm bottom wall axle 21 is received through an axle bore 22 directed through the top wall 18 in a spaced relationship relative to the lock bore 19 parallel to the lock bore, with the first arm bottom wall axle 21 oriented in a parallel relationship relative to the lock bore 19 and positioned in adjacency relative to a rear distal end of the first arm bottom wall 20.

Figure 5:
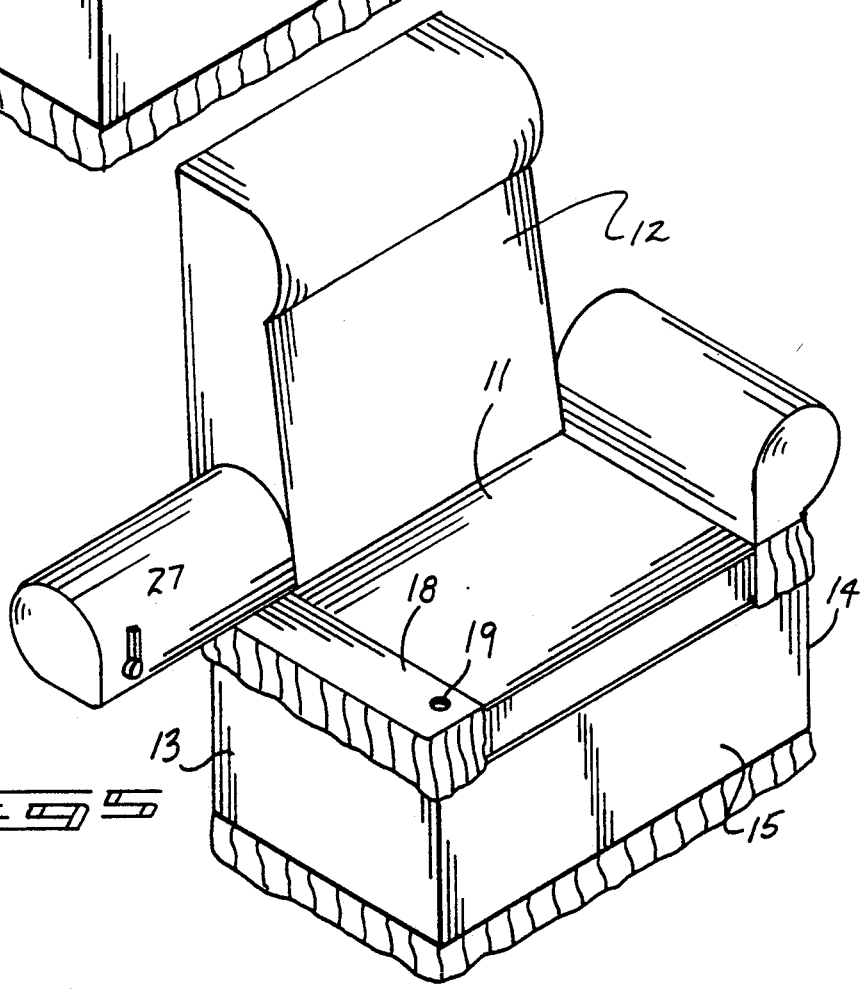
FIG. 5 is an isometric illustration of the chair structure in a second position.
Figure 6:
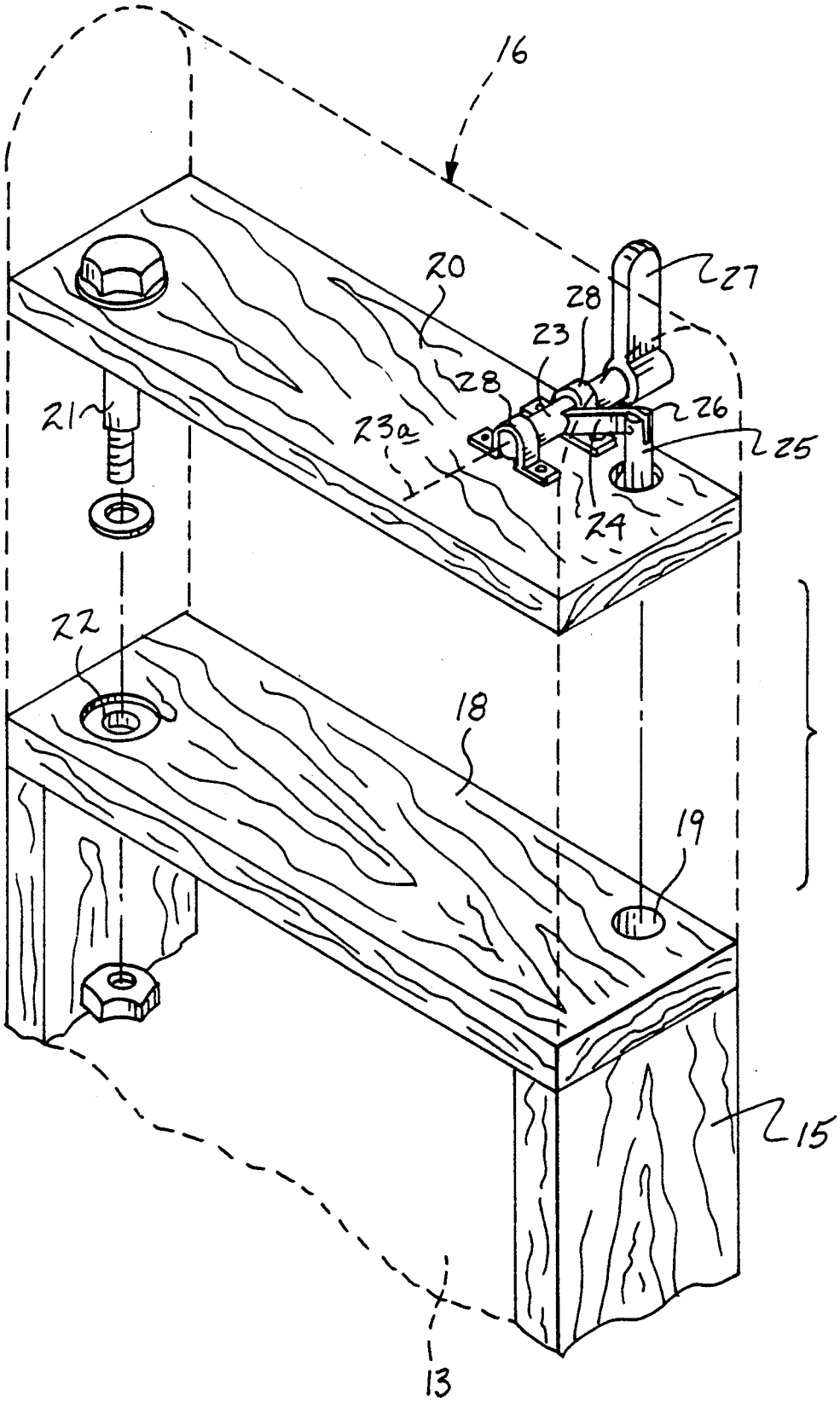
FIG. 6 is an isometric illustration of the latching and pivoting structure of the swing arm member.

Oriented adjacent a forward end of the first arm bottom wall 20 is a cylindrical latch bolt 23 having a latch bolt axis 23*a*. A latch bolt arm 24 orthogonally oriented relative to the axis 23*a* is integrally and medially mounted relative to the latch bolt 23. A latch bolt rod 25 has an upper distal end indicated as a bifurcated first end 26 pivotally mounted to the latch bolt arm 24 to permit pivotal relationship of the latch bolt arm 24 relative to the latch bolt rod 25, whereupon pivoting of the latch bolt 23 provides for selective lifting of the latch bolt rod 25 relative to the top wall lock bore 19 to permit displacement of the swing arm or first arm 16 to the second position, as indicated in FIG. 5. To ease such rotation of the latch bolt 23, a latch bolt lever 27 orthogonally mounted and integrally secured to the latch bolt 23 at a free end thereof exteriorly of the first arm 16 between the first arm 16 and the second arm 17 is mounted to permit ease of lifting of the latch bolt rod 25, in a manner as indicated in FIG. 6 for example.

A plurality of latch bolt saddles 28 extend about the latch bolt 23 and are secured to a top surface of the top wall 18, with the latch bolt arm 24 as indicated oriented between the latch bolt saddles 28.

Figure 7:
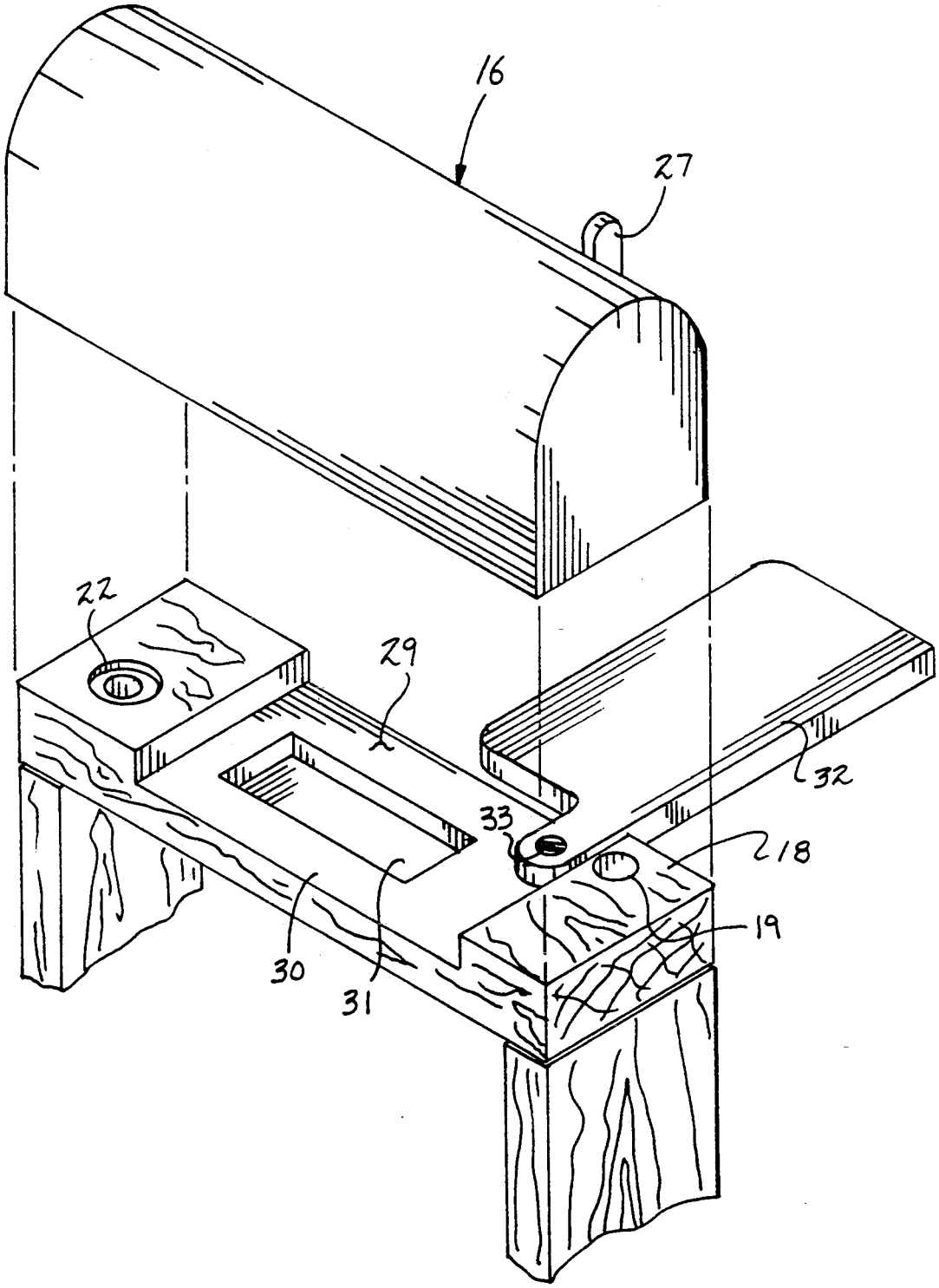
FIG. 7 is an isometric illustration of the side wall top plate having recesses for mounting a desk plate and storage compartment.

FIG. 7 indicates the use of a somewhat modified top wall 18 having a top wall recess 29 extending medially of the top wall, having a recess floor 30 positioned below a top surface of the wall a predetermined height. A floor recess cavity 31 is directed into the recess floor 30 for storage of various components such as pencils, pens, and the like. A desk plate 32 having a predetermined thickness equal to the predetermined height is pivotally mounted about a desk plate axle 33, with the desk plate axle 33 orthogonally directed into the recess floor 30 in a parallel relationship relative to the top wall lock bore 19. In this manner, access to the desk plate 32 is provided for use as a desk structure, wherein various pencils and the like may be stored within the recess floor cavity 31 for use with the desk plate 32.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A swing arm chair apparatus, comprising, a chair having a chair seat, the chair seat including a chair back support extending upwardly of the chair seat, with the chair having a chair base mounted below the chair seat, the chair base including a first side wall and a second side wall, and a front wall, and a first arm extending from the chair back support along the first side wall to the front wall, and a second arm extending along the second side wall from the chair back support to the front wall, and the front wall including a first side wall top wall oriented at an oblique angle to the first side wall mounted integrally at an upper distal end of the first side wall extending from the first side wall to the chair seat, with the first side wall top wall extending from the chair back support to the front wall, and a first arm bottom wall axle mounted to the first arm and directed pivotally through the first side wall top wall permitting pivoting of the first arm from a first position to a second position beyond the first side wall, and latch means mounted to the first arm arranged for selective latching with the first side wall top wall, and the latch means includes a top wall lock bore orthogonally directed through the first side wall top wall in adjacency to the front wall positioned between the first side wall and the chair seat, and the first arm having a first arm bottom wall arranged parallel to the top wall substantially coextensive therewithin, and the first arm bottom wall axle directed orthogonally through the bottom wall, and the latch means further including a cylindrical latch bolt, and a plurality of latch bolt saddles extending about the latch bolt, with the latch bolt saddles mounted to the first side wall top wall, and the latch bolt having a latch bolt axis, and the latch bolt including a latch bolt arm orthogonally oriented relative to the axis mounted medially of the latch bolt between the saddles, and the latch bolt including a latch bolt rod, the latch bolt arm pivotally mounted to the latch bolt rod at an upper distal end of the latch bolt rod, the latch bolt rod arranged for reception within the top wall lock bore when the first arm is in a first position.

2. An apparatus as set forth in claim 1 wherein the first side wall top wall includes a top wall recess extending medially of the top wall, with the top wall recess having a recess floor positioned below a top surface of the first side wall top wall, and the recess floor defined by a predetermined height below the first side wall top wall top surface, and the recess floor having a floor recess cavity for storage of writing components therewithin, and a desk plate, the desk plate defined by a predetermined thickness, wherein the predetermined thickness is equal to the predetermined height, and the desk plate includes a desk plate axle, the desk plate axle is orthogonally directed through the desk plate and orthogonally directed into the recess floor, with the desk plate axle oriented parallel to and spaced relative to the top wall lock wall bore and the first arm bottom wall axle.

* * * * *